US008844736B1

(12) United States Patent
Hangley

(10) Patent No.: US 8,844,736 B1
(45) Date of Patent: Sep. 30, 2014

(54) METHOD AND STAND APPARATUS FOR PERMANENT CREASING OF ARTICLES OF CLOTHING INCLUDING SHIRT SLEEVES, PANTS, AND LINEN DRESS PANTS

(76) Inventor: James Hangley, Long Beach, NY (US)

( * ) Notice: Subject to any disclaimer, the term of this patent is extended or adjusted under 35 U.S.C. 154(b) by 8 days.

(21) Appl. No.: 13/507,961

(22) Filed: Aug. 9, 2012

(51) Int. Cl.

| | |
|---|---|
| ***A47F 7/00*** | (2006.01) |
| ***A47G 29/00*** | (2006.01) |
| ***A47H 1/00*** | (2006.01) |
| ***A47K 10/04*** | (2006.01) |
| ***A47B 43/00*** | (2006.01) |
| ***A47B 47/00*** | (2006.01) |
| ***A47B 57/00*** | (2006.01) |
| ***A47G 25/06*** | (2006.01) |
| ***A41D 1/10*** | (2006.01) |
| ***D06F 71/29*** | (2006.01) |
| ***A47F 7/24*** | (2006.01) |
| ***D06J 1/12*** | (2006.01) |
| ***A47B 61/00*** | (2006.01) |

(52) U.S. Cl.
CPC ..... *A47G 25/0692* (2013.01); *A47G 25/0664* (2013.01); *A41D 1/10* (2013.01); *D06F 71/29* (2013.01); *A47F 7/24* (2013.01); *D06J 1/12* (2013.01); *A47B 61/003* (2013.01)
USPC ..... 211/85.3; 211/193; 211/206; 211/123

(58) Field of Classification Search
CPC ..... A47G 25/72; A47G 25/0685; A47G 25/0692; A47G 25/08; A47G 25/06; A47G 25/02; A47G 25/00; A47G 25/14; A47G 25/1464; A47G 25/74; A47G 25/743; A47G 25/0664; A47B 61/003; A47B 61/00; A47B 61/02; A47B 61/06; A47B 81/00; A47B 57/42; A47B 57/52; A47B 47/022; A47B 47/021; A47B 46/00; A47F 7/24; A47F 7/19; A47F 5/10; A47F 5/106; A47F 5/04; A47F 5/0884; D06J 1/00; D06J 1/12; D06J 1/04; D06J 1/10; D06C 23/00; D06F 71/29; D06F 57/08; D06F 57/06; D06F 71/18; D06F 71/30; D06F 57/00; D06F 57/02; D06F 57/04; A47K 10/04; A47K 10/06; A41D 1/10; A41D 1/06; A41D 1/00; B05D 3/12
USPC ..... 211/85.3, 204, 206, 191, 193, 201, 197, 211/189, 186, 105.1, 123, 183; 118/306, 118/201; 223/28, 29; 427/256, 370, 393.2; 220/62.11, 62.22
See application file for complete search history.

(56) References Cited

U.S. PATENT DOCUMENTS 430,340 A * 6/1890 Eyles ..... 211/206
1,988,710 A 1/1935 Beugler (Continued)

*Primary Examiner* — Jennifer E Novosad
(74) *Attorney, Agent, or Firm* — Richard B. Klar, Esq.; Law Office Richard B. Klar

(57) ABSTRACT

A method and an apparatus for providing permanent creases in articles of clothing such as pants, lined dress pants and shirt sleeves in which the stand has one or two legs connected to a vertical support which in turn is connected to a base. A garment support tray is affixed to the vertical support struts and the base. Each leg has a groove therein which is adapted to receive a V-shaped channel that is affixed preferably by adhesive material to the groove. The V-shaped channel is adapted to receive a preformed crease to an article of clothing therein so that an applicator can be guided along the garments inverted interior crease length depositing adhesive which after curing makes the crease permanent.

10 Claims, 3 Drawing Sheets

(56) References Cited

U.S. PATENT DOCUMENTS

| | | | | | |
|---|---|---|---|---|---|
| 2,115,591 | A | | 4/1938 | Sherbondy | |
| 2,549,722 | A | | 4/1951 | Sweet et al. | |
| 2,557,262 | A | * | 6/1951 | Cordes | 211/191 |
| 3,071,253 | A | * | 1/1963 | Walsh et al. | 211/204 |
| 3,087,654 | A | | 4/1963 | Moore | |
| 3,217,932 | A | | 11/1965 | Steiner | |
| 3,313,425 | A | * | 4/1967 | Injeski | 211/204 |
| 3,363,777 | A | * | 1/1968 | Cooper | 211/85.3 |
| 3,447,488 | A | * | 6/1969 | Lehrman | 108/28 |
| 3,503,525 | A | * | 3/1970 | Loebner | 211/206 |
| 3,534,517 | A | * | 10/1970 | Kann | 52/239 |
| 3,722,702 | A | * | 3/1973 | Marker, Jr. | 211/204 |
| 3,814,292 | A | | 6/1974 | Dargols | |
| 4,182,264 | A | * | 1/1980 | Gibson et al. | 118/306 |
| 4,191,793 | A | | 3/1980 | Gibson et al. | |
| 4,253,578 | A | * | 3/1981 | Rekow | 211/208 |
| 4,380,298 | A | * | 4/1983 | Harig | 211/189 |
| 4,588,154 | A | * | 5/1986 | Basore | 248/99 |
| 4,637,531 | A | | 1/1987 | Olsson | |
| 4,756,170 | A | | 7/1988 | Gibson et al. | |
| 4,932,565 | A | | 6/1990 | Paradiso | |
| 4,934,280 | A | * | 6/1990 | Bae | 108/99 |
| 4,984,515 | A | * | 1/1991 | Pivonka | 99/449 |
| 5,013,378 | A | | 5/1991 | Farah | |
| 5,035,199 | A | * | 7/1991 | Hageman | 118/681 |
| 5,211,755 | A | * | 5/1993 | Hangley, II | 118/306 |
| 5,228,605 | A | | 7/1993 | Schlichenmaier | |
| 5,518,127 | A | * | 5/1996 | Warmack et al. | 211/193 |
| 5,749,498 | A | | 5/1998 | Lavoie et al. | |
| 5,887,764 | A | | 3/1999 | Ennis, III et al. | |
| 6,029,833 | A | * | 2/2000 | Yeh | 211/189 |
| 6,039,228 | A | * | 3/2000 | Stein et al. | 224/532 |
| 6,363,634 | B1 | * | 4/2002 | Hangley | 38/14 |
| 6,364,141 | B1 | * | 4/2002 | Ehrgott | 211/189 |
| 6,422,777 | B1 | | 7/2002 | Landrau et al. | |
| 6,796,701 | B2 | | 9/2004 | Wahlig et al. | |
| 6,935,523 | B2 | * | 8/2005 | Ahn | 211/195 |
| 7,104,412 | B2 | * | 9/2006 | Yong | 211/206 |
| D546,013 | S | * | 7/2007 | Pong et al. | D32/58 |
| 7,293,929 | B1 | | 11/2007 | Atkinson et al. | |
| 7,364,243 | B2 | * | 4/2008 | Wyatt et al. | 312/265.4 |
| 7,562,795 | B2 | | 7/2009 | Whitney | |
| 7,909,186 | B1 | * | 3/2011 | Contreras | 211/124 |
| 8,376,291 | B1 | * | 2/2013 | Groves | 248/166 |
| 2004/0169053 | A1 | | 9/2004 | Liljeqvist | |
| 2005/0051571 | A1 | | 3/2005 | Carruth et al. | |
| 2005/0103737 | A1 | * | 5/2005 | Paventi | 211/206 |
| 2005/0161416 | A1 | * | 7/2005 | Anderson | 211/85.7 |
| 2009/0043282 | A1 | | 2/2009 | Hughes et al. | |
| 2011/0027753 | A1 | | 2/2011 | Maurat et al. | |
| 2011/0091590 | A1 | | 4/2011 | McMahon et al. | |
| 2013/0101739 | A1 | * | 4/2013 | Tomescu et al. | 427/256 |

* cited by examiner

METHOD AND STAND APPARATUS FOR PERMANENT CREASING OF ARTICLES OF CLOTHING INCLUDING SHIRT SLEEVES, PANTS, AND LINEN DRESS PANTS

BACKGROUND

1. Field

The present disclosure relates to an improved method and stand of an apparatus for permanent creasing of articles of clothing including pants, lined dress pants and shirt sleeves. In particular the present disclosure relates to an improved method and stand apparatus for creasing articles of clothing that is easy to use, does not require rotation of leg lances, is simple to assemble, inexpensive to manufacture, and can be used for providing permanent creasing in pants, lined pants and shirt sleeves. Further the present disclosure allows full access to the crease of lined dress pants enabling the operator to visually inspect the application as it is being preformed.

2. The Related Prior Art

U.S. Pat. No. 4,191,793 relates to a method of forming a durable crease in a textile article wherein the stand has rotatable platforms that may pivot 180 degrees by means of a foot pedal. It would be desirable to provide a stand and a method that does not require rotation of the stand to effect providing a durable crease in clothing articles. Without modification this stand does not allow visual inspection of the crease of lined pants requiring the operator to "blindly" apply resin along the crease beneath the lining. This method is inexact and results in "missed creases".

SUMMARY

The present disclosure provides a method and a stand apparatus for providing permanent creases in article of clothing such as pants, lined dress pants and shirt sleeves in which the stand has one or two legs connected to a vertical support which in turn is connected to a base. Each leg has a groove therein which is adapted to receive a V-shaped channel that is affixed preferably by adhesive material to the groove. The V-shaped channel is adapted to receive an inverted preformed crease to an article of clothing therein so that an applicator can be guided along the garments inverted interior crease length depositing adhesive which after curing makes the crease permanent.

DETAILED DESCRIPTION OF THE PREFERRED EMBODIMENTS

Figure 1:
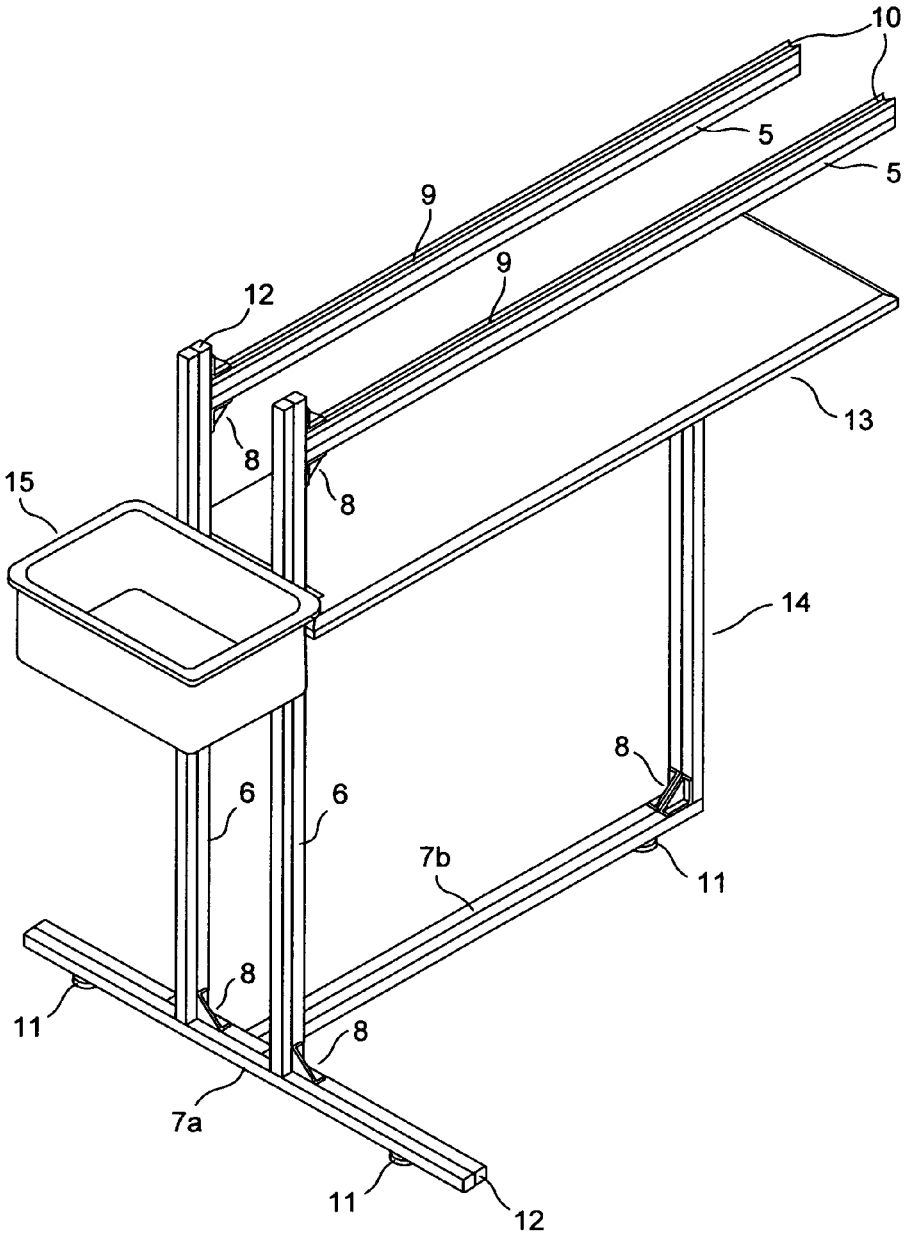
FIG. 1 is a perspective view of a first embodiment of the present invention showing a two leg stand with garment support tray.
Figure 2:
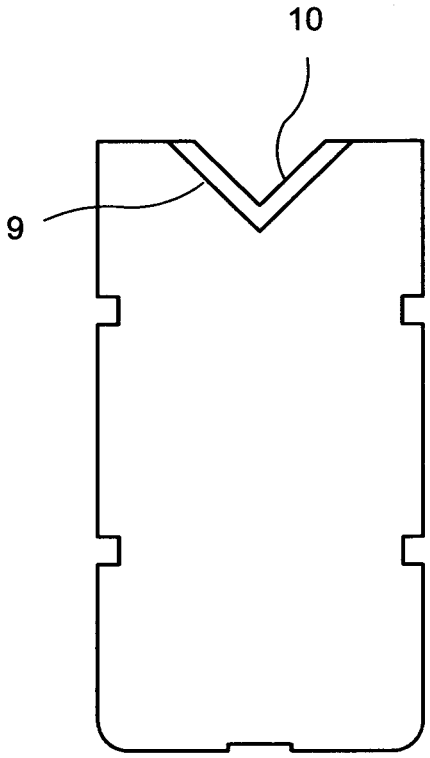
FIG. 2 is a partially exploded view of the embodiment of FIG. 1 showing the groove and a V-channel for adhesive attached/affixed in the groove of the leg.
Figure 3:
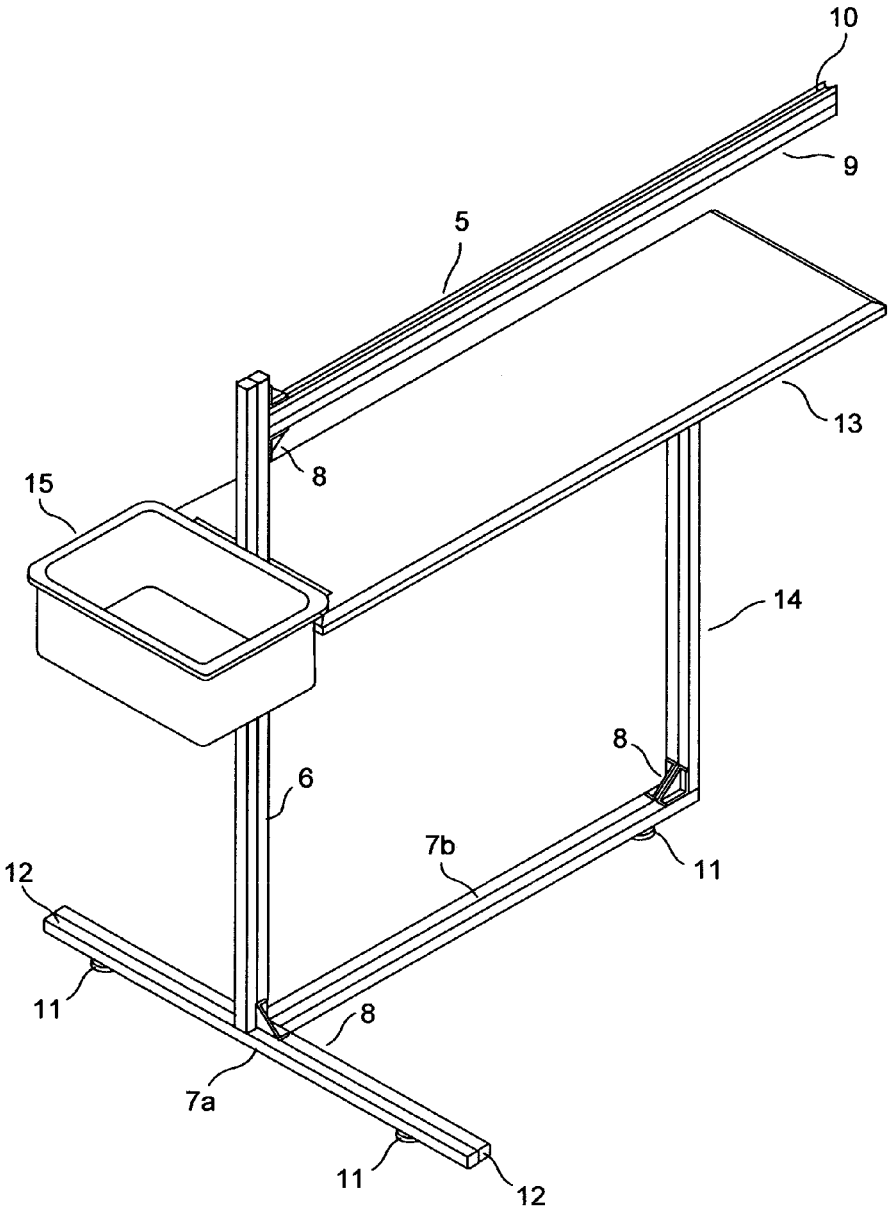
FIG. 3 is another embodiment of the present disclosure showing a one leg stand.

Referring now to FIGS. 1-3 of the drawings, FIG. 1 shows a first embodiment of the present disclosure. FIG. 1 shows a lined dress pant, pant, or shirt sleeve support assembly frame 1 that includes two legs 5, 2 vertically oriented support strut 6 and a base 7 formed of two legs struts 7*a* and 7*b* connected to each other and to the 2 vertical support struts 6 by gussets 8. Two gussets 8 connect the legs 5 to the top portion of the vertical support strut 6 as shown in FIG. 1. The legs 5 have a groove 9 or recess 9 that is preferably machined into its top surface. A V-shaped channel 10 is placed and affixed into the groove 9 preferably using an adhesive resin (see FIG. 2). The groove is preferably dimensioned as 16 mm wide by 8 mm deep by 40½ inches long. The V-shaped channel is preferably dimensioned 10 mm on each side of the V-shape by 3.75 mm deep by 35 inches long. The base struts 7*a*, 7*b* of the stand preferably has floor pads 11 placed there-under as shown in FIG. 1. End caps 12 are preferably placed on the exposed ends of the base struts 7*a* & 7*b*, legs 5 and vertical support struts 6 as shown in FIG. 1. Garment support tray 13 is perpendicularly attached to vertical support struts 6 by gussets 8. It is further supported by tray support strut 14. This embodiment can be used to make creases permanent in lined dress pants, pants and shirt sleeves.

FIG. 3 is another embodiment of the present disclosure in which one leg instead of two legs is used. This embodiment is the same as described above for the embodiment of FIG. 1 except that the one leg instead of two legs are attached to the stand and the arm has a groove therein and a V-shaped channel affixed in the groove. The one leg can be used for the permanent creasing of pants, lined dress pants and shirt sleeves. An applicator as described in Applicant's co-pending non-provisional patent application Ser. No. 13/385,824 filed on Mar. 8, 2012 can be used in conjunction with any of these embodiments of the present disclosure.

While presently preferred embodiments have been described for the purposes of the disclosure, it is understood that numerous changes in the arrangement of apparatus parts can be made by those skilled in the art. Such changes are encompassed within the spirit of the invention as defined by the appended claims.

What is claimed:

1. An apparatus for providing permanent creases in articles of clothing such as pants, linen dress pants and shirt sleeves, comprising:

a stand having at least one leg connected to a vertical support which in turn is connected to a base;

said stand having at least one leg which has a groove therein and a V-shaped channel member that is placed within and affixed to said groove;

said V-shaped channel member accommodating a preformed inverted crease of an article of clothing therein to guide an applicator along said inverted crease length depositing resin which after curing makes said crease in said garment permanent.

2. The stand according to claim 1 wherein said at least one leg is one leg.

3. The stand according to claim 2 wherein said stand includes a garment support tray having said one leg connected thereunder, a vertically oriented support strut and a base and two struts that are vertically oriented with respect to the tray that are connected to the base.

4. The stand according to claim 1 wherein said at least one leg is two legs.

5. The stand according to claim 4 wherein said stand includes a garment support tray including said two legs, a vertically oriented support strut and a base formed of two struts connected to each other and to the base of the stand, said garment support tray having a horizontally extending surface attached at one end to the vertical support struts and said base.

6. The stand according to claim 5 wherein said two struts are connected to each other and to said base of the stand by a plurality of gussets wherein said plurality of gussets connect said legs to a top portion of the vertical strut.

7. The stand according to claim 1 wherein said at least one leg has said groove machined into its top surface.

8. The stand according to claim 1 wherein said V-shaped channel member is placed and affixed into said groove using an adhesive resin.

9. The stand according to claim 1 wherein said groove is dimensioned as 16 mm wide by 8 mm deep by 40½ inches long.

10. The stand according to claim 1 wherein said V-shaped channel member is dimensioned 10 mm on each side of the V-shape by 3.75 mm deep by 35 inches long.

* * * * *